United States Patent [19]

Huffman, Jr.

[11] 4,149,812

[45] Apr. 17, 1979

[54] FOLDABLE WRITING INSTRUMENT

[76] Inventor: Fred A. Huffman, Jr., P.O. Box 893, Rock Springs, Wyo. 82901

[21] Appl. No.: 897,661

[22] Filed: Apr. 19, 1978

[51] Int. Cl.[2] ..... B43K 24/14; A46B 5/02

[52] U.S. Cl. ..... 401/6; 401/195; 401/99

[58] Field of Search ..... 401/6–9, 401/195, 29–31, 99

[56] References Cited

U.S. PATENT DOCUMENTS

| | | | |
|---|---|---|---|
| 2,896,576 | 7/1959 | Baer | 401/195 |
| 2,979,602 | 4/1961 | Barnett | 401/195 |
| 3,257,991 | 6/1966 | Mosch | 401/29 |
| 3,407,021 | 10/1968 | Mosch | 401/195 |

*Primary Examiner*—Clyde I. Coughenour

*Attorney, Agent, or Firm*—Clarence A. O'Brien; Harvey B. Jacobson

[57] ABSTRACT

The present invention comprises a writing instrument of rod-like conformation such as a pen or pencil, the instrument being adapted to pivot medially of its length about a pivot pin to alow the forwardmost writing portion of the instrument to be rotated through a 180 degree angle and received within a housing cavity formed in the rearmost handle portion of the instrument. In use, the present writing instrument can be utilized in the manner of a typical pen or pencil, that is, as a straight rod-like writing instrument, the present writing instrument being alternatively utilized by disposing the two portions at an angle to each other while in use.

2 Claims, 6 Drawing Figures

FOLDABLE WRITING INSTRUMENT

BACKGROUND OF THE INVENTION

1. Field of the Invention

The present invention relates generally to writing instruments and particularly to a writing instrument wherein a forward writing portion is pivotally mounted relative to a rearward handle portion for storage of the writing portion within the handle portion.

2. Description of the Prior Art

Writing instruments have been known to man since long before recorded history, primitive man having used stone stylus structures and similar instruments to form impressions in a substrate such as a rock wall or sandy patch of earth. Man has improved such instruments to the extent of inserting into rod-like "stick" or stylus structures a member containing ink or a member formed of carbon or other material which wears off onto a surface which is to be "written" on. In essence, the development of writing instruments has retained the elongated, rod-like body of the writing instruments familiar to primitive man. The ink-containing and carbon inserts thus fitted into the more modern writing instruments have presented obvious problems, such as the exposure of a sharply pointed end to the user when carried in a pocket or purse, a further problem being the exposure of the ink or other material to contact with clothing or other materials onto which the ink can be deposited, thereby ruining the clothing. These problems have been addressed only by the provision of a separate cap-like structure which is usuable with the writing instrument to cover the exposed "point" of the instrument when not in use. While generally adequate, the separate cap-like structure is often misplaced or lost, thereby causing the user of the writing instrument to be faced with the original problems inherent in the use of such instruments. The writing instruments of the prior art are typically grasped by the thumb and one or more fingers near the "point" of the instrument, the major portion of the writing instrument extending upwardly between the thumb and forefinger and typically resting on adjacent portions of the hand. Small children, handicapped individuals and others often experience difficulty in manipulating these elongated writing instruments, such individuals not being able to readily produce legible writing and often being subjected to sometimes irreversible delays in attaining reasonable writing facility.

The present invention provides a solution to these problems, the writing instrument of the invention being capable of pivoting at a point substantially medially of the length thereof to allow a forwardmost writing portion to be rotated through a substantially 180 degree angle to be received within a housing cavity formed in a rear handle portion of the instrument when the instrument is not in use, such as when the instrument is being carried in a pocket or purse. The "point" of the instrument is thus caused to be held within a housing which is integral with the writing instrument, the "point" of the instrument thus being prevented from contacting the clothing of the user or from being exposed to potentially injure the user. The present writing instrument can be used in the manner of a standard pen or pencil or can be used with the forward and rear portions thereof angled to each other to allow children and others to more easily handle the instrument, thereby to allow production of a high quality level of penmanship. Further, the present writing instrument can be more compactly stored in a pocket or purse due to the fact that the forward portion of the instrument pivots to a position interiorly of the rearward portion of the instrument.

SUMMARY OF THE INVENTION

The present invention provides a writing instrument having a forwardmost writing portion, the free end of which is formed with or otherwise adapted to hold a "point" from which an ink or similar material is caused to flow onto a substrate which is to be written upon or from which carbon or other material "wears" onto a substrate, a rearmost or handle portion of the writing instrument being pivotally mounted to the forward portion of the instrument to allow the forward portion of the instrument to be rotatable through an angle of at least 180 degrees relative to the rearmost portion of the instrument. The forward portion of the instrument is receivable within a housing cavity formed in the rearmost portion of the instrument, thereby allowing the portion of the instrument having the writing point to be housed within the rearward portion of the instrument. The present writing instrument is therefore not only compactly storable in a pocket or purse but also prevents the sharp writing point from being exposed to potentially injure the user or allow ink or other materials from contacting and thereby ruining clothing or other materials with which an exposed writing point can come in contact. The present structure provides a covering for the writing point of the instrument without the need for a separate "cap" which can often become misplaced or lost.

The structure of the present writing instrument allows a user to write with the two portions of the instrument disposed with the longitudinal axes thereof aligned as is standardly practiced with conventional pens or pencils, and the like. Alternatively, the forward portion of the present writing instrument can be angled relative to the rear portion, the forward portion being grasped at least by the thumb and one finger, while the rear portion of the instrument is disposed within the confines of the palm of the hand. Small children, handicapped individuals, and others can therefore more readily utilize the present writing instrument due to the greater ease with which the present writing instrument can be grasped and manipulated when the mutally pivotal portions thereof are angled relative to each other. Penmanship can thereby be improved for those individuals most deficient in such skills.

It is therefore an object of the present invention to provide a writing instrument which can be compactly stored in a pocket or purse, the writing point of the instrument being covered by a portion of the writing instrument which is integral with said writing point, thereby to prevent injury to the user and damage to clothing or articles with which an exposed writing point can come into contact.

It is another object of the present invention to provide a writing instrument having forward and rear portions which are pivotally mounted relative to each other, the forward portion having the writing point formed on the free end thereof being capable of rotation through a substantially 180 degree angle and received within a housing cavity disposed within the rear portion of the writing instrument.

It is a further object of the present invention to provide a writing instrument which can be utilized in a conventional manner and which is pivotable at a point medially of its length, thereby to allow grasping of the writing instrument in a manner which facilitates writing by small children, handicapped individuals, and others who have difficulty manipulating a conventional elongated writing instrument.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
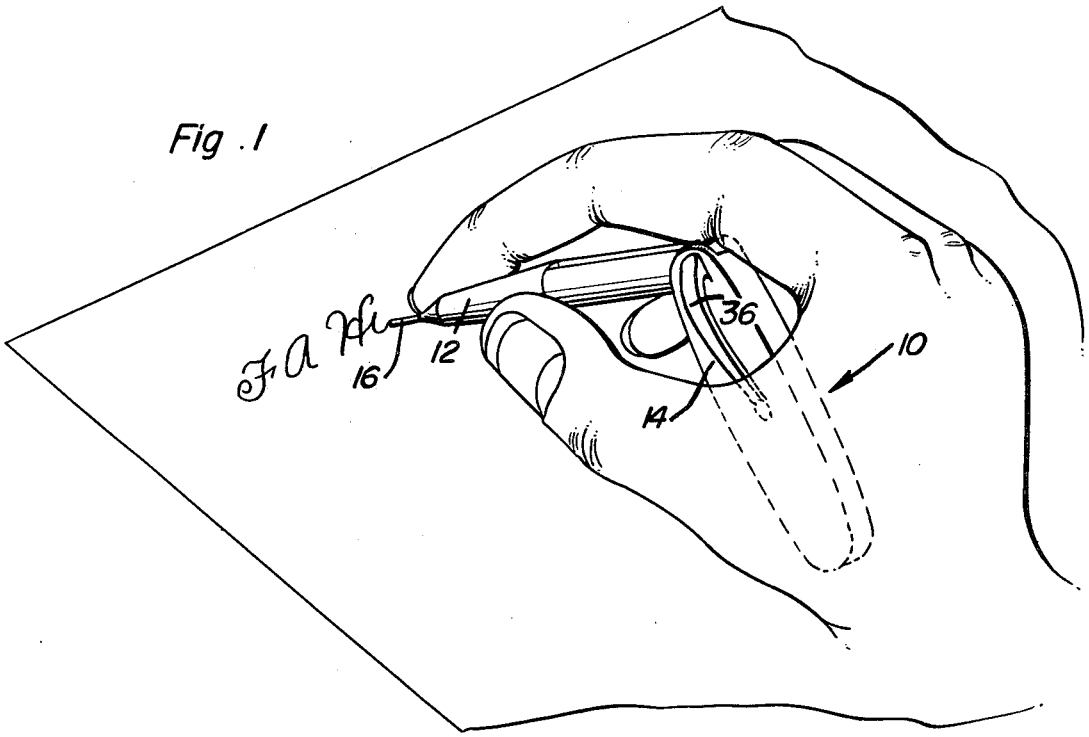
FIG. 1 is a perspective view illustrating the present writing instrument in a use situation.
Figure 2:
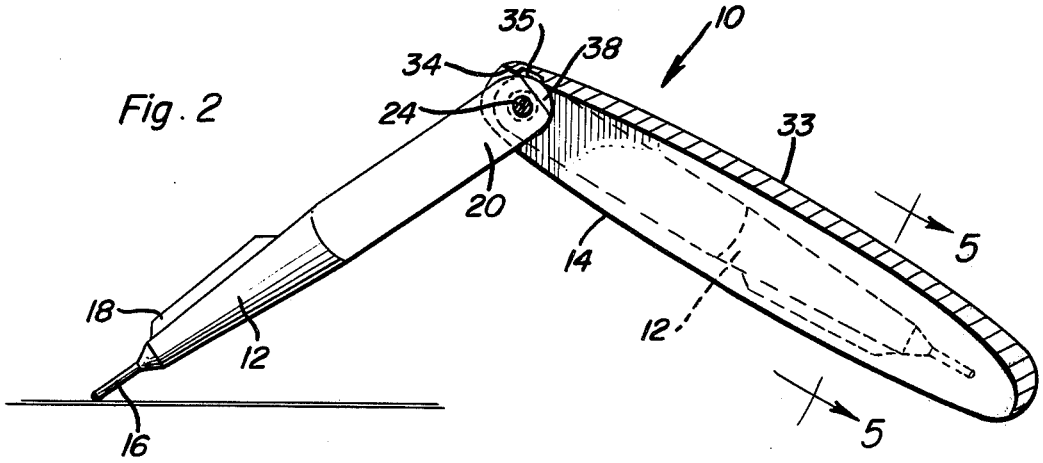
FIG. 2 is an elevational view in partial section illustrating the angular relationship of the portions of the present writing instrument when in an angled conformation, the forward portion of the present writing instrument being shown in phantom to be received within a housing cavity disposed in the rear portion of the writing instrument.
Figure 6:
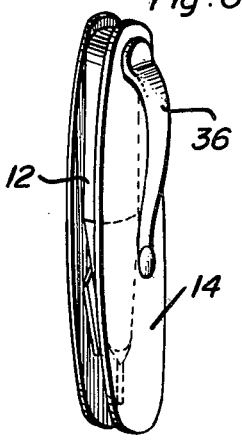
FIG. 6 is a perspective view of the present writing instrument wherein the forward writing portion thereof is received within the rear portion of the instrument.

Referring now to the drawings and particularly to FIGS. 1 and 2, a writing instrument according to the present invention is seen generally at 10 to comprise a forward writing portion 12 and a rear handle portion 14, the portions 12 and 14 being pivotally mounted relative to each other about a pivot pin 24 as will be described hereinafter. The forward writing portion 12 has a writing point 16 disposed at the free end thereof, the writing point 16 typically comprising an ink cartridge of standard but shortened conformation or other structure which enables a user thereof to cause a mark to be made on a desired substrate. Inwardly adjacent of the writing point 16 is disposed a ridge 18 which is adapted to be grasped by a user of the instrument 10 when the forward writing portion 12 is housed within the rear handle portion 14, such as can be seen in phantom in FIG. 2 and also in FIGS. 5 and 6. Rearwardly of the ridge 18, the forward writing portion 12 preferably reduces in diameter near anterior end 20, this reduction in diameter facilitating reception of the forward writing portion 12 within the rear handle portion 14 as well as reducing the volume necessary for the pivotal connection between the portions 12 and 14. An aperture 22 is formed in the anterior end 20 of the forward writing portion 12, the pivot pin 24 being received therethrough as particularly seen in FIG. 4. The pivot pin 24 further extends through apertures 32 formed in spaced side walls 30 of the rear handle portion 14, the spaced side walls 30 at least partially defining housing cavity 28 into which the forward writing portion 12 of the instrument 10 is received as will be described hereinafter. The pivot pin 24 terminates on exterior surfaces of the spaced side walls 30 in pinheads 26 which retain the pivot pin 24 within the respective apertures 22 and 32.

Figure 3:
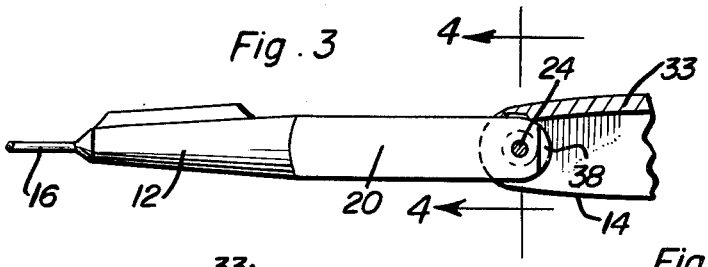
FIG. 3 is a detailed elevational view of the forward portion of the present writing instrument and the pivotal mounting between said forward portion and the rear portion thereof, the writing instrument being shown in a conventional, elongated conformation.
Figure 4:
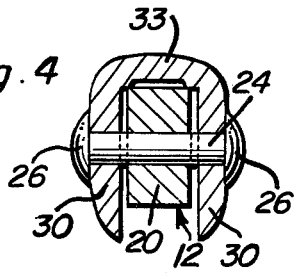
FIG. 4 is a sectional view taken along line 4—4 of FIG. 3.
Figure 5:
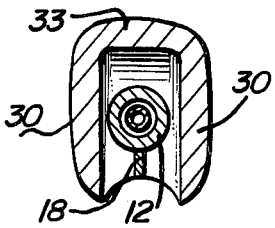
FIG. 5 is a sectional view taken along line 5—5 of FIG. 2.

As can best be seen in FIGS. 2 through 5, the spaced side walls 30 of the rear handle portion 14 are joined along upper adjacent edges by an upper wall 33, the rear handle portion 14 thereby being substantially U-shaped in cross section as particularly seen in FIGS. 4 and 5. The upper wall 33 has a recess 35 formed in surmounting relation to the pivot pin 24 in order to allow free pivotal movement of the rounded anterior end 20 of the forward writing portion 12 when said portion 12 is pivoted relative to the rear handle portion 14. An abutment 34 forms a stop forwardly of the recess 35, the abutment 34 contacting upper surface portions of the anterior end 20 of the portion 12 when the longitudinal axes of the portions 12 and 14 are disposed in aligned relation to each other as seen in FIG. 3. Therefore, the forward writing portion 12 is prevented from further clockwise pivotal rotation relative to the rear handle portion 14, thereby to allow the writing instrument 10 to be used in the manner of a standard pen or pencil, that is, the portions 12 and 14 can be maintained in an extended elongated configuration such that the instrument 10 can be grasped and supported in a conventional manner during use thereof.

As can particularly be seen in FIGS. 2 and 5, the forward writing portion 12 of the writing instrument 10 can be rotated substantially through a 180 degree angle relative to the rear handle portion 14 and received within the housing cavity 28 formed within the handle portion 14. Therefore, when the instrument 10 is not in use, as when the instrument is being carried in a pocket or purse, the writing point 16 is thereby caused to be held within the housing cavity 28, thereby to prevent the writing point 16 from contacting the clothing of the user when the instrument 10 is carried in a pocket. The writing point 16 is further maintained in an unexposed position when held within the housing cavity 28, thereby to reduce the exposure of a user to potential injury from the relatively sharp writing point 16. As can also be seen in FIG. 2, a cap 38 formed on the interior end 20 of the forward writing portion 12 allows access to the interior of the forward writing portion 12 such that an ink cartridge or other unit forming the writing portion of the instrument 10 can be replenished or replaced. As can further be seen in FIG. 6, a clip 36 can be disposed on one of the spaced side walls 30 of the rear handle portion 14 in order to facilitate secure reception of the writing instrument 10 within a pocket of a user. It is to be noted that the end of the clip 36 connected to the side wall 30 is disposed at the end of the rear handle portion 14 at which the pivot connection is formed, thereby assuring that the portion 12 does not swing out of the housing cavity 28 accidentally when the instrument 10 is clipped within a pocket.

As particularly shown in FIG. 1, the writing instrument 10 can be utilized in a manner in which prior writing instruments cannot be used. Since certain individuals, including small children, handicapped individuals and others often experience difficulty in manipulating elongated writing instruments of conventional design, the present writing instrument 10 provides a device which allows more ready grasping and convenient manipulation by a user. The writing instrument 10 is capable as aforesaid of pivoting about the pivot pin 24, the pivot pin 24 preferably being disposed at a point substantially medially of the length of the instrument 10 to allow the forward writing portion 12 to be rotated from an extended configuration through an angle preferably less than 90 degrees to the position shown generally in FIGS. 1 and 2. The forward writing portion 12 is therefore angled relative to the rear handle portion 14 preferably at an obtuse angle, children and other individuals thereby being enable to more easily handle the instrument and produce a higher quality level of penmanship. Accordingly, the structure of the present writing instrument 10 allows a user to write with the portions 12 and 14 disposed with the longitudinal axes thereof aligned, as shown in FIG. 3, as is standardly practiced with conventional pens, pencils and the like. Alternatively, as shown in FIGS. 1 and 2, the forward writing portion 12 of the instrument 10 can be angled relative to the rear handle portion 14, the forward writing portion 12 thereby being grasped at least by the thumb and one finger while the rear handle portion 14 is disposed within the confines of the palm of the hand. The writing instrument 10 can therefore be more readily grasped with ease by small children and certain other individuals to allow more ready manipulation of the instrument 10 and to provide improvement to the penmanship of such individuals. As a further advantage, as particularly seen in FIG. 6, the writing instrument 10 can be more compactly stored within a pocket or purse due to the ability of the forward writing portion 12 to be housed within the rear handle portion 14.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the sacope of the invention.

What is claimed as new is as follows:

1. A compact, foldable writing instrument comprising, in combination:

a first elongated body member having a generally frustum-shaped forward portion terminating at a free end, said free end having an aperture formed therein and running axially through said frustum, and a first body rear portion having a substantially rectangular cross section and extending from said frustum to and including a pivot axis;

a writing means having a single ink containing portion connected to a single writing tip, said ink containing portion being received within said aperture and said writing tip extending through said aperture for contact with a writing surface;

a second elongated body member having a pair of spaced substantially planar body side walls and a laterally extending connecting wall attached to said body side walls longitudinally along one peripheral edge of each body side wall for defining a cavity for receiving said first body member, said spaced side walls having aligned apertures formed therein, said aligned apertures being positioned in alignment with said pivot axis of said first body member;

a pivot pin being received through said aligned apertures in said pivot axis thereby forming a pivotal engagement between said body members such that said first body member may be disposed in longitudinal alignment with said second body member or pivoted into a received position within said cavity formed by the walls of said second body member or disposed in any given angular orientation between the longitudinal alignment or received position;

a longitudinally extending ridge member attached laterally of said frustum and extending away from said second body member when said first body member is in the received position; and an abutment formed on the pivoted end of the second body member to form a stop to prevent pivotal movement of the first body member beyond the longitudinally aligned position, said abutment being defined by a free end of said laterally extending wall and a recess formed in said laterally extending connecting wall proximate said abutment for receiving the pivotal end of said first body member and allowing free pivoting of that member until engagement with said abutment.

2. The writing instrument of claim 1 and further including a clip disposed on the second body member and extending laterally outward from one of said spaced side walls, said clip being fixedly attached on the end of said second body member containing the pivotal attachment to said first body member.

* * * * *